US005102225A

United States Patent [19]

Hollinger et al.

[11] Patent Number: 5,102,225

[45] Date of Patent: Apr. 7, 1992

[54] UTENSIL BAG FOR DISHWASHERS

[76] Inventors: Lawrence E. Hollinger, 14215 Ravenhurst, Houston, Tex. 77070; Michael T. Vincitore, 3302 Candlelon, Spring, Tex. 77388

[21] Appl. No.: 670,569

[22] Filed: Mar. 18, 1991

[51] Int. Cl.[5] ..... B65D 33/01; B65D 33/14

[52] U.S. Cl. ..... 383/23; 206/0.5; 383/35; 383/102; 383/117

[58] Field of Search ..... 383/23, 102, 103, 117, 383/35; 134/201; 206/0.5

[56] References Cited

U.S. PATENT DOCUMENTS

| | | | |
|---|---|---|---|
| 893,934 | 7/1908 | Moore | 383/102 |
| 1,915,196 | 6/1933 | McGuire | 383/102 |
| 2,544,223 | 3/1951 | Ellis | 383/102 |
| 2,602,482 | 7/1952 | Lyon | 383/102 |
| 2,804,898 | 9/1957 | Cox | 383/102 |
| 2,818,900 | 1/1958 | Forman | 383/102 |
| 3,331,221 | 7/1967 | Lawson, Jr. | 383/102 |
| 4,630,312 | 12/1986 | Milstein | 383/102 |
| 4,714,353 | 12/1987 | Leaphart | 383/102 |
| 4,974,967 | 12/1990 | Tsuyoshi et al. | 383/102 |

*Primary Examiner*—Stephen P. Garbe

[57] ABSTRACT

A flexible open-mesh bag installable in a dishwasher for containment of lightweight items that are subject to being thrown around the interior space of the dishwasher due to the force of water spraying onto the dishes being washed. The bag is preferably an elongated tubular envelope having one open end for insertion or removal of items. Suspension devices are connected to the bag for removably attaching the bag to one of the racks in the dishwasher.

3 Claims, 1 Drawing Sheet

UTENSIL BAG FOR DISHWASHERS

BACKGROUND AND SUMMARY OF THE INVENTION

This invention relates to a bag formed of a flexible open mesh plastic material for holding various items in fixed positions in an automatic dishwasher.

Conventional household dishwashers usually comprise upper and lower racks for containment of silverware, plates, bowls, glasses and other items that are to be washed. A water spray device is associated with each rack for spraying heated water on the items in the rack. Typically each water spray device will comprise a horizontal arm mounted below the rack for rotary motion around a central vertical axis. Ports are formed along the upper face of the arm for discharging jets of water upwardly out of the arm and onto the undersides of the items in the rack (located above the water spray arm). The arm is constructed so that water supply pressure causes the arm to rotate around a central point along the length of the arm. The water spray arm thus rotates as its sprays the items in the rack, such that all of the items are subjected to the water spray action.

Small lightweight items in the rack are sometimes dislodged from the rack, due to the force of the water sprays. In some cases these small items can become airborne and subsequently fall through openings in the rack so as to eventually be deposited on the bottom wall of the dishwasher.

Most dishwashers include an electrical heating element on the dishwasher bottom wall for heating the space within the dishwasher, to thus promote drying of the washed items. In the event that an item inadvertently contacts the heating element it may melt or otherwise destruct, due to the relatively high temperature on the heating element surface.

The present invention relates to an add-on bag structure installable in a dishwasher for containment of small lightweight items that might have a tendency to become airborne due to the force of the water sprays associated with normal dishwasher operation. Items that could be held in the bag include rubber baby bottle nipples; baby bottle caps; plastic spoons, forks and knives; small measuring spoons and cups; and small drinking glasses, light weight lids, etc.

The bag is designed to completely envelope the items so that the force of the water sprays cannot dislodge the items; the items remain in the bag during the machine cycle (washing, rinsing, and drying). The bag is anchored to one of the racks in the dishwasher. However, it can be manually removed from the rack to facilitate insertion of items into the bag or removal of items from the bag.

The use of add-on racks in dishwashers in shown in U.S. Pat. No. 3,727,622 to J. Jacobs, and U.S. Pat. No. 4,834,125 to R. Insalaco. Neither of these patents discloses a flexible bag for completely enclosing (enveloping) items that are subject to being thrown around within the dishwasher.

THE DRAWINGS

DESCRIPTION OF A PREFERRED EMBODIMENT OF THE INVENTION

Figure 1:
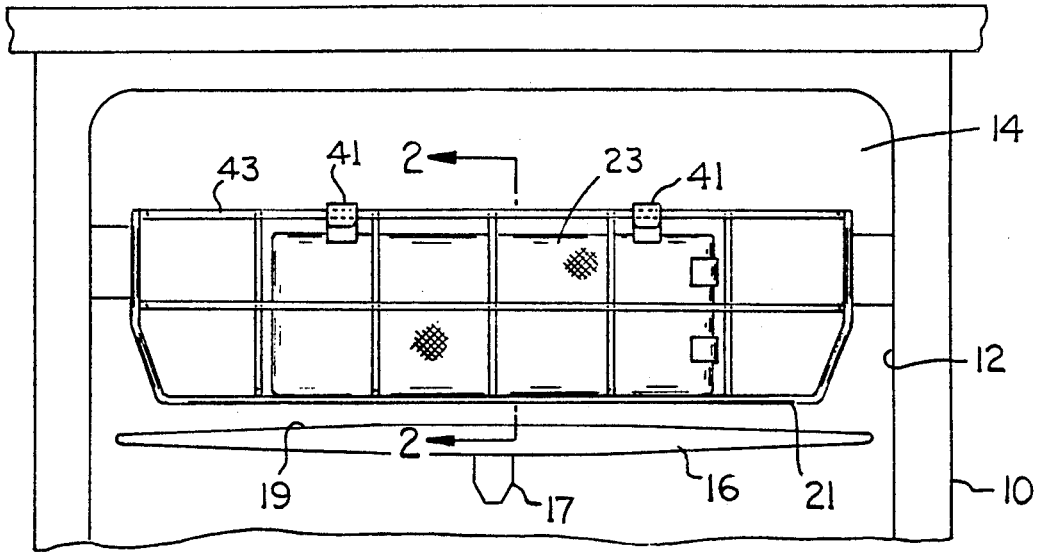
FIG. 1 is a fragmentary front view of a conventional dishwasher showing a rack structure therein. A bag of the present invention is shown suspended from the rack structure.

The drawings show a conventional dishwasher 10 having a door opening 12 for access to an otherwise closed space 14 that houses two dishracks; the upper dishrack shown in FIG. 1 is designated by numeral 21.

The space immediately below the illustrated dishrack contains a hollow water spray arm 16 that is mounted on a stationary water supply pipe structure 17. Arm 16 has a rotary connection with pipe structure 17, such that while water is being delivered to the spray arm the arm rotates around a central vertical axis (i.e. a vertical axis located at the geometrical center of space 14). Spray arm 16 has a series of water ports spaced along its upper face 19, for delivering jets of water upwardly against items supported in the illustrated rack. As seen in FIG. 1, spray arm 16 has a length that is almost the side-to-side dimension of enclosed space 14. The rotary spray arm thereby has essentially complete spray coverage of the rack contents.

Figure 3:
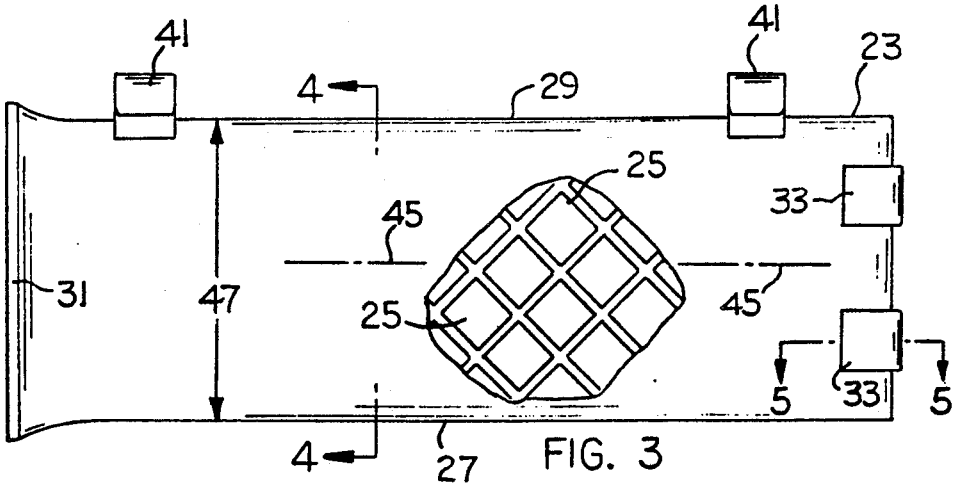
FIG. 3 is an enlarged front elevational view of the bag shown in FIG. 1.

The present invention relates to an add-on plastic bag 23 formed of a plastic open mesh plastic material. FIG. 1 shows the bag suspended within rack 21. FIG. 3 shows the bag detached from the rack. The bag is formed out of a single piece of plastic sheet material having regularly-spaced square openings 25 extending therealong. The entire surface of the envelope has openings therethrough, as indicated by the broken-away area in FIG. 3.

Figure 4:
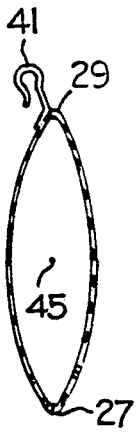
FIG. 4 is a sectional view taken on line 4—4 in FIG. 3.
Figure 5:
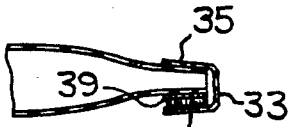
FIG. 5 is a fragmentary sectional view taken on line 5—5 in FIG. 3.

The bag may be formed by a single rectangular sheet of open mesh material formed into a hollow tubular envelope configuration, as shown in FIG. 4; the axis of this tube is designated by numeral 45. The longitudinal end edges of the tubular wall are connected together to form an edge seam 27. An elongated edge or crease 29 is formed along the tube in diametrically spaced relation to seam edge 27, whereby the formed tubular envelope has a generally oval transverse cross-section, as seen in FIG. 4. The oval cross section continues along the length of the tube except that left transverse edge areas 31 of the tube are flattened together and fastened to close the tubular envelope.

The right end of the tubular envelope is left open to permit items to be inserted into the envelope or removed from the envelope. To minimize the possibility of items inadvertently falling out of the envelope one or more flexible closure straps 33 are carried on the right transverse end of the envelope. Each strap 33 has one end portion 35 attached to the tube material. The free end of each flexible strap has a patch of adhesive material 37 thereon. A second adhesive patch 39 is carried on the outer surface of the envelope to mate with patch 37 when the flexible strap is extended across and around the opening in the end of the envelope. Patches 37 and 39 can be formed on interlocking miniature hook and loop fibrous materials marketed under the tradename VELCRO.

Two envelope suspension members 41 are attached to longitudinal edge 29 of the envelope at spaced points therealong. Each suspension member can be a resilient hook formed of a plastic material for secure snap-on engagement over a rod 43 that forms part of rack 21. The suspension members could be of other configurations, e.g. a flexible, twistable tie structure adapted to encircle rod 43, or a short strap having a snap fastener means for attachment around the rod.

Figure 2:
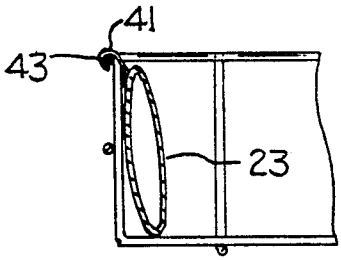
FIG. 2 is a fragmentary sectional view taken on line 2—2 in FIG. 1.

The envelope is preferably installed onto rack 21 so that it is firmly attached to the rack, but is nevertheless removable from the rack when it becomes necessary to insert items into the envelope or remove items from the envelope. In its installed position the envelope has its longitudinal axis 45 extending horizontally parallel to rod 43, from which the envelope is suspended. The envelope can be located within the rack structure in a position lying partially against the front rod portions of the rack, as shown in FIG. 2. The envelope has a length dimension (parallel to axis 45) that is substantially greater than its transverse dimension 47 (FIG. 3), such that the envelope can fit within the rack structure while still having sufficient volumetric capacity to contain a desired number of items. Typically the envelope has a length of about twelve inches and a transverse dimension of about four or five inches.

The envelope is preferably located within the rack so as to avoid interference with the door of the dishwasher; in some dishwashers there is very little clearance between the rear face of the door and the front edge of the associated rack. Hence the envelope should be located within the rack, not in front of the rack.

It might be thought that the envelope could be suspended below rack 21. However, in many dishwashers the water spray arm 16 has a rotational orbit wherein its tip ends travel into close proximity to the rear face of the dishwasher door. Therefore, it is preferred to suspend the envelope within the rack rather than underneath it.

The envelope has a normal cross-sectional configuration that is oval in nature, as shown in FIG. 4. However, the envelope material will have some resilience and a memory, such that a manual squeezing pressure on edges 27 and 29 can cause the opening in the right end of the envelope to be widened for expeditious insertion or removal of items that are wider than the normal width of the envelope opening.

It is believed that the add-on bag could be used with a range of different model dishwashers. The bag is not designed for use with a specific dishwasher. A principal feature of the bag is that it completely encloses the contained items.

The drawings necessarily show a specific embodiment of the invention. However, it will be appreciated that some changes could be made while still practicing this invention. For example the bag can be formed of different materials, such a woven metal or porous cloth. Also, the shape of the bag can be varied, e.g. a square configuration or an elongated rectangular configuration. As another feature, the bag walls could be pleated for purposes of expanding the bag volume (in its opened condition). Also, the bag could be attached to the dishwasher rack in various different ways, e.g. VELCRO (trademark) fasteners, spring hooks, snaps, or ties. The bag opening could have various different locations relative to its positionment on the rack.

The description has been directed to particular embodiments of the invention in accordance with the requirements of the United States patent statutes. It will be apparent to those skilled in the art however, that modifications in the apparatus are possible without departing from the invention. It is intended that the following claims be interpreted to embrace all such modifications.

I claim:

1. A bag for holding light weight items in an automatic dishwasher during the washing cycle; said bag comprising an elongated tubular envelope formed of a flexible open mesh material; said tubular envelope having a longitudinal axis parallel to the defined tube, and a transverse axis normal to the longitudinal axis; said tubular envelope having first and second transverse ends extending normal to the longitudinal axis; said first transverse end being closed by flattening opposed areas of the tube material together; said second transverse end being open for insertion of items into the envelope or removal of items from the envelope; said tubular envelope having a generally oval transverse cross section that defines first and second parallel longitudinal edges spaced apart along the major axis of the oval; two envelope suspension members extending from said first longitudinal edge of the envelope tubular wall at longitudinally spaced points therealong; said suspension members being adapted to engage a frontmost horizontal rod on a pull-out rack in a dishwasher for suspending the elongated tubular envelope from the rack.

2. The bag of claim 1, and further comprising a closure strap carried at said second transverse end of the envelope; said closure strap having a first portion thereof anchored to the envelope material, and a second portion thereof extendable across the envelope opening to bring opposed areas of the tube material together for closure of the envelope.

3. The bag of claim 2, wherein said tubular envelope is formed of a plastic material that has a resilience and a memory, whereby a manual squeezing pressure can be applied to the longitudinal edges of the envelope to temporarily widen the opening at said second end of the envelope.

* * * * *